United States Patent [19]

Sumikawa et al.

[11] 4,266,604

[45] May 12, 1981

[54] HEAT EXCHANGER WITH FLUID TANKS MADE OF SYNTHETIC RESIN

[75] Inventors: Seiji Sumikawa; Hiroshi Niizuma; Hiromichi Tonegawa; Tsuneo Torizuka; Yoichiro Furuya; Norio Takashima, all of Konan, Japan

[73] Assignee: Diesel Kiki Co., Ltd., Tokyo, Japan

[21] Appl. No.: 64,750

[22] Filed: Aug. 8, 1979

[30] Foreign Application Priority Data

Aug. 23, 1978 [JP] Japan ..... 53-102481

[51] Int. Cl.[3] ..... F28F 9/02

[52] U.S. Cl. ..... 165/176; 165/178; 165/DIG. 8

[58] Field of Search ..... 165/176, DIG. 8, 150, 165/178, 69, 82, 173, 175

[56] References Cited

U.S. PATENT DOCUMENTS

| | | | |
|---|---|---|---|
| 2,612,349 | 9/1952 | Lintern | 165/175 |
| 2,878,656 | 3/1959 | Domal | 165/150 |
| 3,258,068 | 6/1966 | Hollister | 165/176 |
| 3,583,478 | 6/1971 | Fieni | 165/178 |
| 3,889,745 | 6/1975 | Siemonsen | 165/176 |

FOREIGN PATENT DOCUMENTS

| | | | |
|---|---|---|---|
| 529275 | 8/1956 | Fed. Rep. of Germany | 165/173 |
| 2115434 | 10/1971 | Fed. Rep. of Germany | 165/DIG. 8 |
| 2734958 | 2/1979 | Fed. Rep. of Germany | 165/175 |
| 2749205 | 5/1979 | Fed. Rep. of Germany | 165/176 |
| 8112 | of 1911 | United Kingdom | 165/175 |
| 913270 | 12/1962 | United Kingdom | 165/147 |

*Primary Examiner*—Sheldon J. Richter

*Attorney, Agent, or Firm*—Frishauf, Holtz, Goodman & Woodward

[57] ABSTRACT

A heat exchanger adapted for use as a hot water radiator for a car heater, or the like, in which a plurality of tubes and a plurality of fins secured thereon extend between two fluid tanks. The fluid tanks each comprise an inner and an outer tank element, both made of synthetic resin. The inner tank element is joined via gaskets with the end portions of the tubes extending therethrough, by means of tube-expansion working, while the outer tank element is united with the inner tank element along corresponding opposed peripheral edges thereof arranged in abutting relation. A pair of partition walls are provided in opposed relation between the inner and outer tank elements, which are joined together in an abutting manner directly or via part of the gasket, to provide a fluid tight partition between an inlet chamber and an outlet chamber defined by the partition walls and the tank elements. The heat exchanger thus has a compact and lightweight construction of a sufficient mechanical strength, easy to assemble and resistant to rust and corrosion.

9 Claims, 10 Drawing Figures

HEAT EXCHANGER WITH FLUID TANKS MADE OF SYNTHETIC RESIN

BACKGROUND OF THE INVENTION

The present invention relates to a heat exchanger adapted for use as a hot water radiator for a car heater, or the like, and particularly to a heat exchanger of such type, which has no brazed portion.

Generally, a heat exchanger of this kind includes a plurality of tubes extending through a number of parallel plate fins, wherein a secondary fluid such as air streams over the plate fins to heat a primary fluid such as water flowing in the tubes by heat exchange with the latter.

The tubes have end portions connected to opposed fluid tanks to which are connected pipes which communicate with an associated fluid circuit. In such heat exchanger, the joints of parts such as those between the tubes and the tanks should have sufficient fluidtightness as well as shock resistance.

To meet with such requirements, according to U.S. Pat. No. 3,583,478 for instance, a heat exchanger has been proposed which includes two tanks each formed by a manifold or end plate and a cap-like header, said manifold comprising a sheet which is made of a metal plate and includes annular flanges defining openings and a sheet-like gasket having annular flanges defining openings corresponding to the openings of said sheet and urged against said sheet with the flanges thereof internally lining the flanges of said sheet. Tubes have end portions sealingly inserted into the annular flanges of said gasket, said end portions being expanded to have a diameter larger than the respective remaining portions of the tubes to crimp the gasket between the tubes and the manifold. Each manifold has a peripheral flange bent around the peripheral flange of the associated header for sealed engagement therewith.

In such proposed heat exchanger, there is a problem that with a long time of use the thermal fluid (e.g., cooling water) may permeate through the gasket, usually made of rubber and internally lining the manifold, which may cause the manifold to rust. Furthermore, the peripheral joint portion of the manifold and header of the tank obtained by crimping the peripheral edge of the manifold projects outwardly of the heat exchanger body so that the whole size of the heat exchanger is necessarily large.

BRIEF SUMMARY OF THE INVENTION

It is therefore an object of the invention to provide a long-lived heat exchanger in which the tanks are entirely made of rust proof synthetic resin, and thus the joints between the tanks and the tubes are free from rust and corrosion.

It is a further object of the invention to provide a heat exchanger which is compact in size and light in weight.

It is a still further object of the invention to provide a heat exchanger which permits the assemblage or joining of the tank component parts to be carried out in a simple, certain and effective manner, leading to reduction in the cost of production.

According to the invention, the tanks comprise a pair of opposed and spaced inner tank elements, made of synthetic resin, and two outer tank elements, also made of synthetic resin, the inner and outer tank elements of each tank having corresponding associated peripheral edges thereof united together in abutting manner. The inner tank elements each have generally substantially flat opposite end surfaces and are formed with a plurality of openings. Fitted into the openings are gasket tubular bodies which in turn receive a plurality of tubes having opposite end portions fitted therein in a fashion that said opposite end portions each have at least one portion expanded to urge the respective gasket tubular body against the inner peripheral surface of the corresponding opening in the associated inner tank element to have a diameter larger than the remaining portion of the tube to clamp the tubular body between the tube and the inner tank element. Two partition walls are provided on opposed end walls of one of the inner tank elements and the associated outer tank element, dividing the thermal fluid space defined by the inner and outer tank elements into an inlet chamber and an outlet chamber. The two partition walls have corresponding opposed marginal ends thereof united together in an abutting manner, directly or via a central coupling portion of a sheet-like gasket element sealingly held between said marginal ends.

These and other objects, features and advantages of the invention will become more apparent upon a reading of the following description and the accompanying drawings.

DETAILED DESCRIPTION

Figure 3:
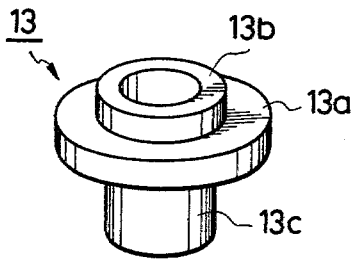
FIG. 3 is a perspective view of the gasket used in the embodiment of FIGS. 1 and 2.

An embodiment of the invention will be described with reference to FIGS. 1 through 3.

Figure 1:
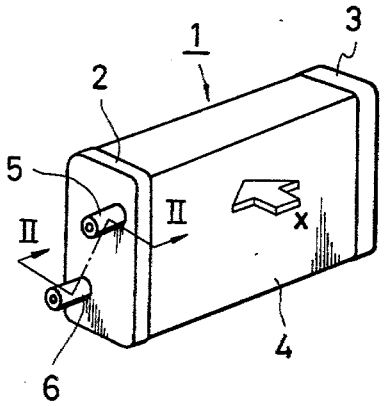
FIG. 1 is a schematic perspective view of the heat exchanger according to one embodiment of the invention.

As shown in FIG. 1, the heat exchanger 1 comprises a heat exchange section 4, and tanks 2, 3 connected to the opposed ends of the heat exchange section. The heat exchange section 4 consists of a number of plate fins 10 vertically disposed in parallel with each other and a plurality of tubes 11 extending through the plate fins, as shown in FIG. 2. The tubes 11 are horizontally disposed in two front and rear longitudinal rows, the tubes in each row being arranged in vertically spaced relation to each other. The tubes 11 have opposite end portions connected, respectively, to the tanks 2, 3 for providing the fluid passage therebetween.

The tank 2 has its interior divided by vertical partition walls 9, 19 formed centrally on opposed inner walls thereof, into two front and rear chambers, i.e., an inlet chamber 7 having an inlet pipe 5 and an outlet chamber 8 having an outlet pipe 6. The tubes 11 in the front row have respective end portions penetrating through the inward end wall of the inlet chamber 7, while those in the rear row have respective end portions inserted into the inward end wall of the outlet chamber 8, such that said end portions open in these chambers. Similarly in the tank 3, the other end portions of the tubes open in the chamber 12 of the tank 3.

Under this arrangement, the thermal medium introduced into the inlet chamber 7 of the tank 2 via the inlet tube 5 is guided to pass through the horizontal tubes 11 in the front row into the chamber 12 of the tank 3, where it is turned into the tubes 11 in the rear row and introduced into the outlet chamber 8 of the tank 2.

In the heat exchange section 4, the secondary fluid or air is guided to stream through the section 4 in the direction of the arrow x or perpendicularly to the extending direction of the tubes 11, to be heated by the primary fluid flowing in the tubes 11.

Figure 2:
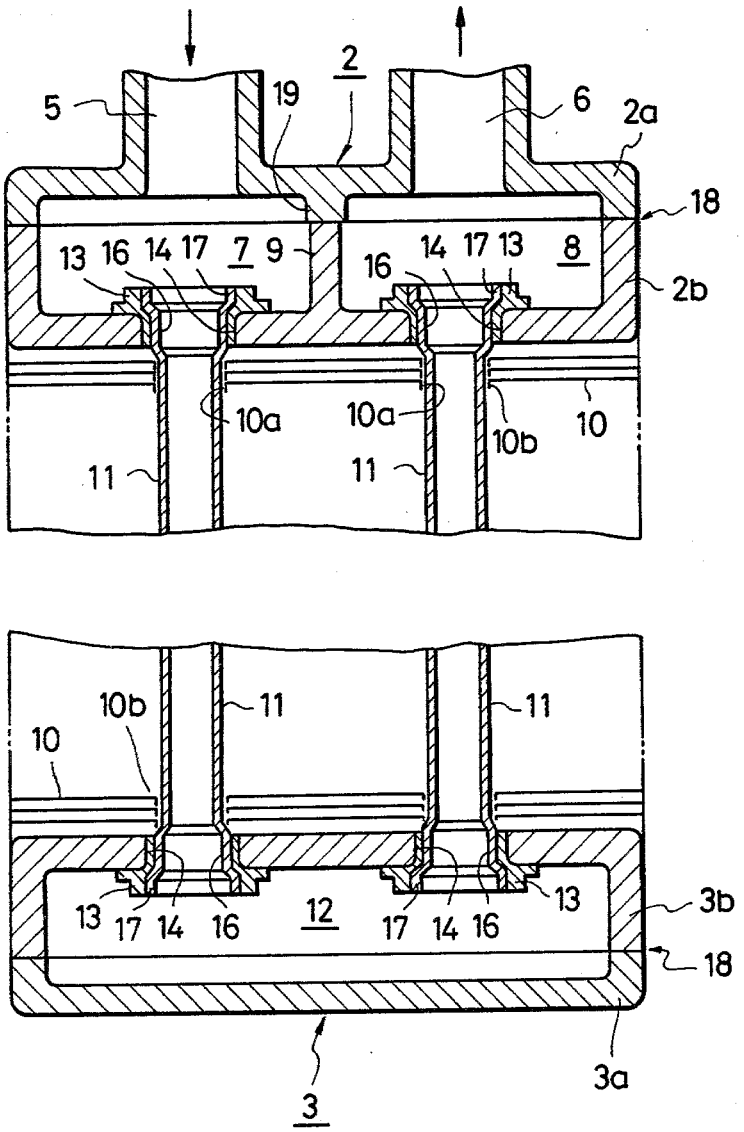
FIG. 2 is a horizontal sectional view taken along line II—II of FIG. 1.

As seen in FIG. 2, each plate fin 10 has a plurality of holes 10*a* through which the tubes 11 penetrate. Each of the holes 10*a* is encircled by an annular flange 10*b* integrally formed on the fin 10 by means of drawing with a press. This annular flange 10*b* has a predetermined length so that adjacent plate fins 10 are kept at a prescribed distance from each other. Each tube 11 is expanded along its length so as to have its outer surface urged against the inner wall of the hole 10*a* of the plate fin 10 to obtain a tight connection of the two members.

The tank 2 consists of an outer element 2*a* and an inner element 2*b*, while the tank 3 consists of an outer element 3*a* and an inner element 3*b*. The outer elements 2*a*, 3*a* are united with the inner elements 2*b*, 3*b*, respectively, after the tubes 11 have been joined to the inner tank elements 2*b*, 3*b*, to complete the tanks 2, 3. These outer and inner elements of the tanks 2, 3 are molded out of a synthetic resin material such as 6,6-nylon containing a glass fiber mixed therein, for instance.

The inner tank element 2*b* (3*b*) has substantially flat opposite end wall surfaces formed with holes 14 through which the end portions of the tubes 11 penetrate. Sealingly fitted in these holes 14 are gaskets 13 made of a flexible material such as rubber, either of natural origin or of synthetic origin, as shown in FIG. 3. The gasket 13 consists of a tubular or hollow cylindrical body 13*b* of larger diameter, a tubular or hollow cylindrical body 13*c* of smaller diameter continuing from said body 13*b*, and an annular radial flange 13*a* radially projecting between said cylindrical bodies 13*b*, 13*c*. The cylindrical body 13*c* is adapted to be fitted into the hole 14, as seen in FIG. 2.

Each end portion of each tube 11 of the heat exchange section 4 is passed through the cylindrical body 13*c* of the gasket 13 fitted in each hole 14 in an associated inner element 2*b* (3*b*). Then, a first expanding portion denoted by numeral 16 of the end portion of the tube 11 is expanded to be stuck to the inner surface of the hole 14. While, a second expanding portion designated by 17 endwise adjacent said first expanding portion 16 is expanded into a larger diameter than the latter to obtain a fluidtight joint between the end portion of the tube 11 and the inner element 2*b* (3*b*). The operations of expanding said first and second expanding portions are carried out concurrently.

After said joining operation of the tubes and the inner tank elements, the joining operation of the inner tank elements and the outer tank elements is carried out. The peripheral edge of an outer tank element 2*a* is aligned with the opposed peripheral edge of an associated inner tank element 2*b* while simultaneously the marginal end of the partition wall 9 is aligned with the opposed marginal end portion of the corresponding partition wall 19 formed on the outer tank element 2*a*, to provide a joint zone 18. The joint zone 18 is subjected to gluing by an adhesive or to friction welding, thus forming a complete tank 2. Said friction welding is carried out by imparting vibrations by means of ultrasonic wave or like means to the abutting peripheral edges of the outer and the inner tank elements and the marginal ends of the partition walls to cause frictional heat in the joint zone 8 which melts the surface portions of the peripheral edges or the marginal ends into an integral joint. Then, an inlet pipe 5 and an outlet pipe 6 are attached integrally or discretely to the outer tank element 2*a*. On the other hand, also in the tank 3, a similar butt joining to that mentioned above is applied to the opposed peripheral edges of the outer and the inner tank elements 3*a*, 3*b*.

Figure 4:
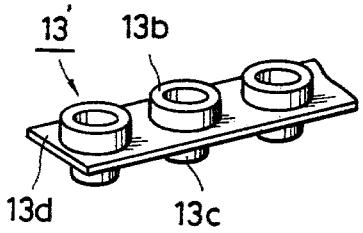
FIG. 4 is a perspective view illustrating another example of the gasket.

As shown in FIG. 4, the gasket 13 may be formed of an integral body 13′ consisting of a plurality of hollow cylindrical bodies 13*b*, 13*c* in the same row which are combined together by a band-like radial flange 13*d* formed between the bodies 13*b* and 13*c*, the cylindrical body 13*c* being adapted to be inserted into the hole 14 in the inner tank element 2*b* or 3*b*.

As described above, according to the invention, the outer and the inner tank elements 2*a*, 3*a*, 2*b*, 3*b* are joined together in abutting manner by means of an adhesive or friction welding. This manner of joining does not require forming the peripheral edges of the tank elements as flanges, enabling to reduce the whole size of the heat exchanger in depth and height.

Further, the partition wall 9 formed on the tank 2 strengthens the whole construction of the tank. The tank 3 may also be provided partially with a reinforcing wall similar to the partition wall 9.

Figure 5:
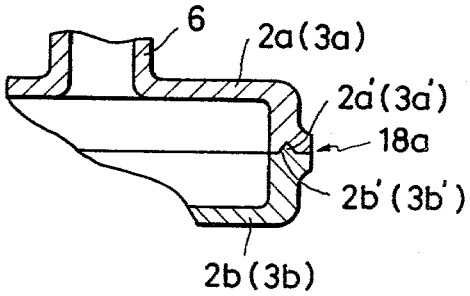
FIG. 5 is a horizontal sectional view of another example of the joint between an inner tank element and an outer tank element of the heat exchanger according to the invention.

FIG. 5 illustrates a modified form of the butt joint portion of the tank elements 2*a*, 2*b* (3*a*, 3*b*). The joint 18*a* has a groove 2*a*′ (3*a*′) of a V-shaped cross section formed in one of the abutting surfaces of the peripheral edges of the tank elements, and a ridge 2*b*′ (3*b*) of a section corresponding to said groove on the other abutting surface. Thus, the joint between the outer and the inner tank elements can have a higher strength.

Figure 6:
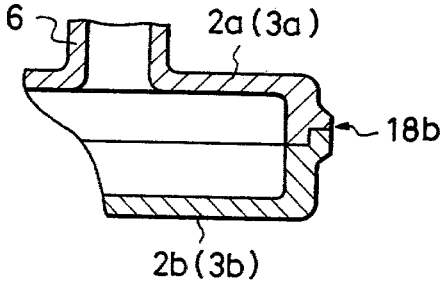
FIG. 6 is a horizontal sectional view of another example of said joint.

The joint 18 may be provided with offsets formed in the abutting surfaces of the peripheral edges of the tank elements, as shown as joint 18*b* in FIG. 6.

Figure 7:
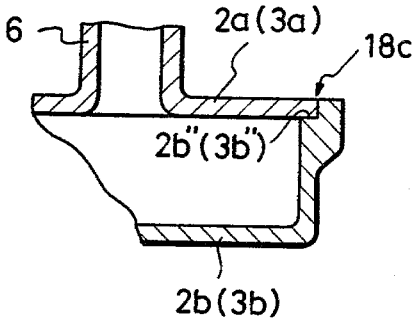
FIG. 7 is a horizontal sectional view of still another example of the joint.

Alternatively, as illustrated in FIG. 7, as joint 18*c*, the peripheral edge of the inner tank element 2*b* (3*b*) may be elongated, of which the marginal portion has an increased thickness. An annular notch 2*b*″ (3*b*″) is cut in an inner peripheral edge surface of the inner tank element 2*b* (3*b*), while the outer tank element 2*a* (3*a*) is formed as a flat plate with its peripheral edge fitted in said peripheral notch 2*b*″ (3*b*″).

These joints 18*a*, 18*b*, 18*c* in modified forms are also subjected to gluing by an adhesive or to friction welding.

Figure 8:
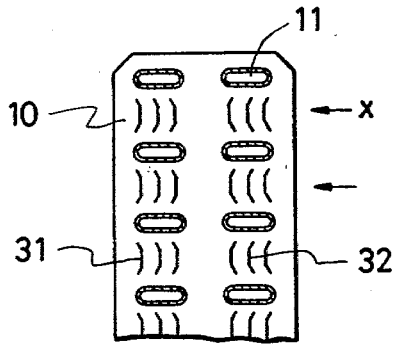
FIG. 8 is a side sectional view of a plate fin and tubes used in the heat exchanger according to the invention.

The plate fin 10 and the tube 11 employed in the above-described embodiments are made of copper, aluminum or an alloy thereof. The tube 11 may be of a circular cross section. However, it can be of an oval cross section as shown in the example of FIG. 8. The tube 11 in FIG. 8 has a section elongated in the same direction as the direction of flow of air indicated by symbol x.

In order to cause exchange of air between adjacent air passages defined by adjacent plate fins 10, each plate fin 10 is provided with louvers 31, 32 which are formed by making cuts in the fin wall and raising them into slanted fins. The fins of the louvers 31, 32 are directed in opposite directions to each other, so that said louver fins have an acute angle and an obtuse angle with respect to the direction of flow of air. These oppositely directed louver fins 31, 32 may be disposed in an optional suitable arrangement.

Thus, the oval cross section of the tube 11 increases the heat transfer area of the whole tube, while the louvers provided in the plate fins 10 permit exchange of air between the adjacent air passages. Even in the case of using such oval tubes, the tubes 11 and the fins 10 can be firmly joined together by virtue of the tube-expansion working as described above. Also, the oval tubes 11 and the inner tank elements 2*b*, 3*b* can be joined together in a similar manner to that employed in the embodiment of FIG. 2.

Figure 9:
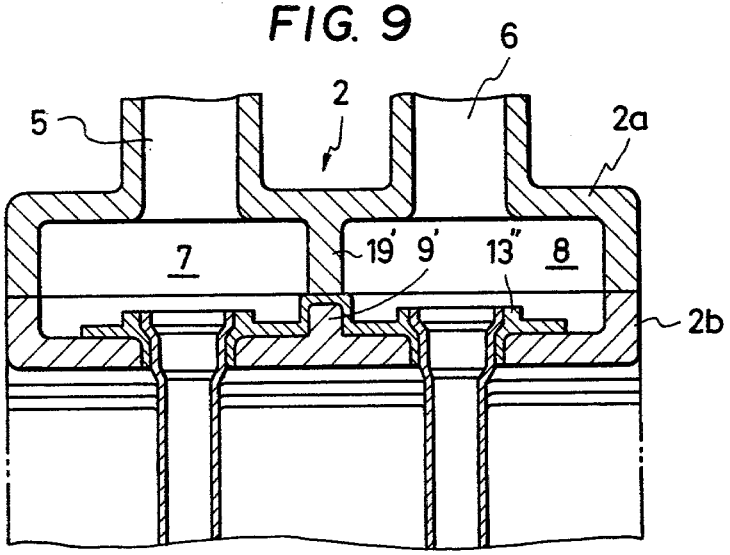
FIG. 9 is a horizontal sectional partial view of the heat exchanger according to another embodiment of the invention.
Figure 10:
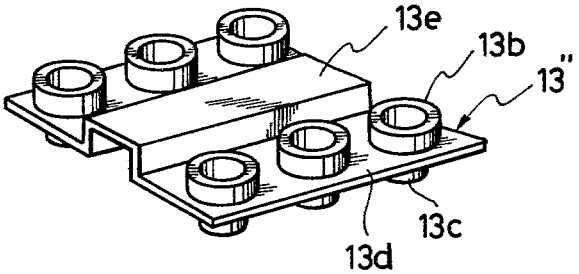
FIG. 10 is a perspective view of an example of the gasket used in the embodiment of FIG. 9.

FIG. 9 illustrates the tank 2 according to another embodiment of the invention. A small gap is provided between the central partition wall 19′ of the outer tank element 2*a* and the central partition wall 9′ of the inner tank element 2*b*, which gap is occupied by part of a sheet-like integral gasket 13″ having a plurality of hollow cylindrical bodies 13*b*, 13*c*. This gasket 13″ is a combination of two gaskets similar to the gasket 13′ illustrated in FIG. 4, and includes a central U-shaped coupling portion 13*e* coupling together the two gaskets. The coupling portion 13*e* is inserted into said gap in a state slightly compressed by the opposed marginal ends of the partitions 19′, 9′ when the outer tank element 2*a* and the inner tank element 2*b* are joined together. By said construction and arrangement, fluidtightness between the partitions 19′ and 9′ can be easily obtained. Such construction and arrangement solves the problem inherent in the embodiment of FIG. 2 that the partitions 19, 9 are somewhat difficult to unite together as compared with the joint between the opposed peripheral edges of the elements 2*a*, 2*b*, due to the difficulty of applying pressure to the central part of these elements 2*a*, 2*b* in the joining operation of these elements.

The construction of the invention as described above can produce the following excellent results:

(1) Since the whole tanks are made of synthetic resin which is resistant to rust, and such tanks and the ends of the tubes made of aluminum or like material are joined together via gaskets in a fluidtight manner by means of tube-expansion working, there is no fear that alien substances stay in the joints to corrode the same. Particularly, after assemblage of the tanks and the tubes, the chemicals which were used in pickling for removal of lubricating oil used in the tube-expansion working and rustproof treatment of the joints, do not stay in the joints, and consequently the joints can be prevented from corroding due to remaining chemicals.

(2) The tanks are formed by outer and inner tank elements which are joined together in an abutting manner by means of an adhesive or friction welding, and accordingly no flanged portion needs to be provided on either of the tank element, the whole size of the heat exchanger can be smaller in depth and height.

(3) If friction welding is used in joining together the tank elements, the joint working can be carried out with certainty and efficiency, leading to a lower cost of production.

(4) The whole tank construction made of synthetic resin is light in weight.

While preferred embodiments of the invention have been described, such description is for illustrative purposes only, and it is to be understood that changes and variations may be made without departing from the spirit and scope of the following claims.

What is claimed is:

1. A heat exchanger comprising:

two inner tank elements each made of synthetic resin, arranged in opposed and spaced relation, each inner tank element having substantially flat opposite end wall surfaces and formed with a plurality of openings;

a first and a second outer tank element each made of synthetic resin, each outer tank element being united with an associated one of said inner tank elements to define thermal fluid spaces in cooperation therewith, the first outer tank element having an inlet and an outlet for thermal fluid;

partition means dividing the thermal fluid space defined by the first outer tank element and the associated inner tank element into an inlet chamber and an outlet chamber, said partition means comprising two partition walls formed integrally on opposed end walls of said first outer tank element and said associated inner tank element, the partition walls having opposed marginal ends thereof united together in an abutting manner;

gasket means having tubular bodies fitted in the respective openings of said inner tank elements;

a plurality of tubes extending between the inner tank elements, each tube having opposite end portions extending through associated ones of the tubular bodies of the gasket means, said opposite end portions each having at least one portion expanded to urge the respective tubular body against the inner peripheral surface of the corresponding opening in the associated inner tank element so as to have a diameter larger than the remaining portion of the tube to clamp the tubular body between the tube and the inner tank element; and a plurality of fins secured on said tubes, the inner tank elements and associated ones of the outer tank elements thereby having corresponding opposed peripheral edges thereof united together in an abutting manner.

2. The heat exchanger as recited in claim 1, wherein the corresponding opposed peripheral edges of said inner tank elements and the associated outer tank elements are united by means of an adhesive.

3. The heat exchanger as recited in claim 1, wherein the corresponding opposed peripheral edges of said inner tank elements and the associated outer tank elements are united together by means of friction welding.

4. The heat exchanger as recited in any one of claims 1, 2 or 3, wherein said opposed marginal ends of said partition walls are united together in an abutting manner by means of an adhesive.

5. The heat exchanger as recited in any one of claims 1, 2 or 3, wherein said opposed marginal ends of said partition walls are united together in an abutting manner by means of friction welding.

6. The heat exchanger as recited in any one of claims 1, 2 or 3, wherein said tubes each have a circular cross section.

7. The heat exchanger as recited in any one of claims 1, 2 or 3, wherein said tubes each have an oval cross section.

8. The heat exchanger as recited in any one of claims 1, 2 or 3, wherein said fins each have a plurality of louvers.

9. A heat exchanger comprising:

two inner tank elements each made of synthetic resin arranged in opposed and spaced relation, each inner tank element having generally substantially flat opposite end wall surfaces and formed with a plurality of openings;

a first and a second outer tank element each made of synthetic resin, each outer tank element being united with an associated one of said inner tank elements to define thermal fluid spaces in cooperation therewith, the first outer tank element having an inlet and an outlet for thermal fluid;

two partition walls formed integrally on opposed end walls of said first outer tank element and associated one of said inner tank elements, the partition walls having marginal ends thereof arranged in opposed relation and dividing in cooperation the thermal fluid space defined by the first outer tank element and the associated inner tank element into an inlet chamber and an outlet chamber;

a pair of gasket means having tubular bodies fitted in the respective openings of said inner tank elements, one of said gasket means on the side of said first outer tank element including a sheet-like element having a central coupling portion integrally coupling together the tubular bodies, sealingly held between the partition walls on the first outer tank element and the associated inner tank element;

a plurality of tubes extending between the inner tank elements, each tube having opposite end portions extending through associated ones of the tubular bodies of the gasket means, said opposite end portions each having at least one portion expanded to urge the respective tubular body against the inner peripheral surface of the corresponding opening in the associated inner tank element so as to have a diameter larger than the remaining portion of the tube to clamp the tubular body between the tube and the inner tank element; and a plurality of fins secured on said tubes, the inner tank elements and associated ones of the outer tank elements thereby having corresponding opposed peripheral edges thereof united together in an abutting manner.

* * * * *